United States Patent [19]

Kamp et al.

[11] Patent Number: 4,899,025

[45] Date of Patent: Feb. 6, 1990

[54] HEATING APPARATUS COMPRISING AT LEAST TWO INDEPENDENT INDUCTORS

[75] Inventors: Ronald P. T. Kamp; Johannes P. De Meij, both of Eindhoven, Netherlands

[73] Assignee: U.S. Philips Corporation, New York, N.Y.

[21] Appl. No.: 278,706

[22] Filed: Dec. 1, 1988

[30] Foreign Application Priority Data

Dec. 16, 1987 [NL] Netherlands ..... 8703043

[51] Int. Cl.[4] ..... H05B 6/08

[52] U.S. Cl. ..... 219/10.57; 219/10.71; 219/10.79

[58] Field of Search ..... 219/10.77, 10.75, 10.79, 219/10.71, 10.69, 10.57, 8.5

[56] References Cited

U.S. PATENT DOCUMENTS

| | | | |
|---|---|---|---|
| 2,714,648 | 8/1955 | Blok et al. | 219/10.79 |
| 2,773,161 | 12/1956 | Baker | 219/10.77 |
| 2,856,499 | 10/1958 | Stanton et al. | 219/10.75 |
| 3,109,909 | 11/1963 | McBrien | 219/10.79 |
| 3,573,416 | 4/1971 | Drechsler | 219/8.5 |
| 4,327,265 | 4/1982 | Edinger et al. | 219/10.77 X |
| 4,425,489 | 1/1984 | Pav et al. | 219/10.79 X |
| 4,506,131 | 3/1985 | Boehm et al. | 219/10.77 |

*Primary Examiner*—Philip H. Leung

*Attorney, Agent, or Firm*—Bernard Franzblau

[57] ABSTRACT

An inductive heating apparatus includes two or more inductors (2, 3) connected to a single high-frequency generator (1). With such a heating apparatus, for example, the two supports (9, 10) in a cathode ray tube can be heated simultaneously. In order to have the heating of each support proceed properly, the heating operations of the individual supports (9, 10) should be effected independently. Independent interruption of the electromagnetic power transfer from the inductors (2, 3) to the supports (9, 10) is preferably effected by axially moving away from the workpiece (4) a coil core (6, 8) inside the associated induction coil (5, 7). This is advantageous in that the case of low-ohmic inductors no large currents and in the case of high-ohmic inductors no large voltages need to be switched. In addition, the induction coils, which in the case of low-ohmic inductors (2, 3) often consist of an internally cooled tubular conductor, can then be rigidly mounted.

7 Claims, 1 Drawing Sheet

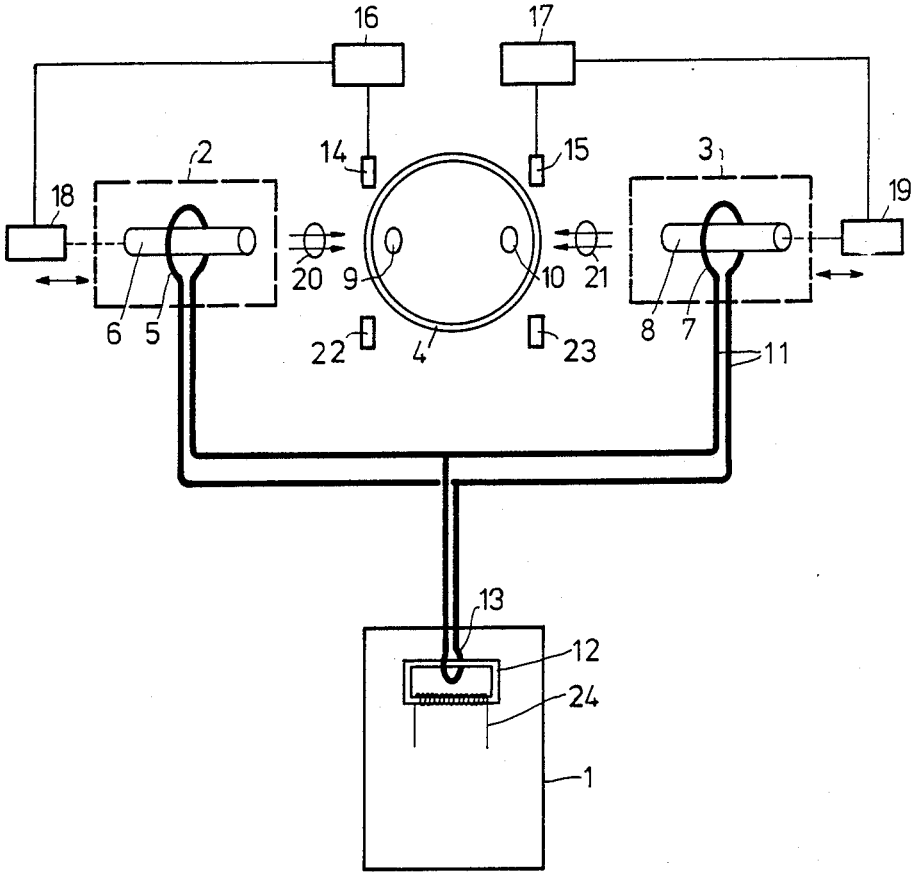
16
17
14
15
2
3
18
19
20
9
10
21
6
5
8
7
22
4
23
11
13
12
24
1

HEATING APPARATUS COMPRISING AT LEAST TWO INDEPENDENT INDUCTORS

BACKGROUND OF THE INVENTION

This invention relates to a heating apparatus comprising a high-frequency generator and at least two inductors connected to the high-frequency generator for inductively heating workpieces in which each inductor is formed by an induction coil comprising a high-permeability coil core, which coil cores can be displaced mutually independently.

Such a heating apparatus is known from the U.S. Pat. No. 3,109,909.

Since high-frequency generators for industrial heating purposes are relatively expensive arrangements, it is generally desired to connect two or more inductors to a single high-frequency generator in such a heating apparatus.

It is likewise desired in this context that these inductors can be switched on and off mutually independently. If they can be switched independently of one another it is then possible to have different workpieces or different parts of a workpiece undergo an individual heat treatment per inductor, requiring the high-frequency generator to be on.

Switching the inductors on and off mutually independently is possible, for example, by switching the current to or the voltage through an inductor. Specifically, with relatively large power level this will cause problems, however, because large currents cause a high amount of dissipation in a conductive switch, and when switching high voltages, sparkover will readily occur.

The heating apparatus in the above U.S. Pat. No. 3,109,909 comprises four inductors connected to a single high-frequency generator, each inductor consisting of a single induction coil and a coil core, the latter being formed by a fixed portion and an adjustable portion. Each workpiece or part of a workpiece receives an individual heat treatment because the inductor can be adapted to the shape of the workpiece with the aid of the adjustably mounted coil core. This adjustability is realised by threadedly adjusting the core or using a different type of rigid positioning. Such rigid positionings do not generally allow the apparatus to be readily modified, as a result of which they are less suitable for use in a heating apparatus that has to operate automatically, as described in the preamble.

Consequently, the known heating apparatus is not suitable for manufacturing processes in which workpieces may have a large variation of form and/or size, leading to a specific process parameter showing an ever different variation in time. Therefore, this heating apparatus is unsuitable for automatically processing such workpieces.

SUMMARY OF THE INVENTION

It is an object of the invention to provide a heating apparatus of the type mentioned in the preamble which is capable of heating successively and automatically workpieces having large dimensional tolerances and which is capable of heating per workpiece different regions of this workpiece mutually independently in a single process stage.

In order to accomplish the foregoing object, the invention is characterized in that the heating apparatus comprises at least one detector for detecting at least one process parameter in the induction heating process, and the heating apparatus further includes displacing means for displacing the coil cores in response to detection signals emanating from the detectors in order to switch the power transfer on and off.

Due to tolerances of material compositions and dimensions of the workpieces, a process parameter (such as, for example, the temperature or the amount of evaporated getter in a getter process) will generally vary per workpiece. The detectors detect the relevant process parameter and apply detection signals to the displacing means which can switch the electromagnetic power transfer on and off by moving each coil core towards and away from the vicinity of the workpiece, but still inside the induction coil. This technique of switching the electromagnetic power transfer on and off by moving the coil core in dependence on a process parameter constitutes the innovative concept of the invention.

A heating apparatus comprising an advantageous embodiment of the displacing means according to the invention is characterized in that the displacing means displace the coil cores substantially axially.

Since the coil cores can be moved towards and away from the workpiece in a rapid and efficient way, this heating apparatus is highly suitable for heating workpieces in an automatic process.

BRIEF DESCRIPTION OF THE DRAWING

The invention will now be further explained with reference to the FIGURE representing an embodiment of the heating apparatus according to the invention in which the inductors are provided in the form of induction coils having axially movable coil cores.

DESCRIPTION OF THE PREFERRED EMBODIMENT

The heating apparatus according to the FIGURE comprises a high-frequency generator 1 and two inductors 2 and 3 connected in parallel to the high-frequency generator 1 via supply lines 11 (cooled if necessary). Depending on the impedance desired by the high-frequency generator 1, the inductors 2 and 3 could also be connected in series. The inductors 2 and 3 comprise the respective induction coils 5 and 7 and the respective coil cores 6 and 8. The impedance of an induction coil remains substantially constant when the associated coil core is moved but still remains inside the induction coil. In this case moving a coil core in a single induction coil axially will rather have no effect on the current through the other induction coil. The high-frequency generator 1 is designed to have a transformer core 12 having a primary winding 24 of a relatively large number of turns and a secondary winding 13 of only a single turn. This secondary winding 13 is formed by a single conductor (internally cooled, if required) connected to the induction coils 5 and 7 via the supply lines 11.

The workpiece 4 in the FIGURE is placed between the inductors 2 and 3. This workpiece 4 can, for example, consist of a cathode ray tube housing ring-shaped supports 9 and 10 having a getter.

Such a cathode ray tube is first evacuated and subsequently sealed. The annular supports 9 and 10 with the getter are situated in the neighbourhood of the wall of the cathode ray tube so as to have as large a portion as possible of the high-frequency electromagnetic flux generated by the induction coils enclosed by the annular supports 9 and 10. The flux is symbolically represented in the FIGURE by means of the arrows 20 and 21. By enclosing the high-frequency electromagnetic flux the conductive supports 9 and 10 are heated. Once the getter in the supports 9 and 10 starts to evaporate, it will deposit on the wall of the cathode ray tube 4 and form a getter spot there, which will bind the still remaining residual gases.

Due to the unavoidable inaccuracy in the positioning of the supports 9 and 10 with getter with respect to the front face of the coil cores 6 and 8, the flux enclosed by the supports will vary for the individual cases. With a substantially constant high-frequency power supply provided by the high-frequency generator 1, too little getter would evaporate within a specific period of time in such the supports 9, 10 containing little flux, and in such of the supports 9, 10 containing excessive flux too much heat could be developed with the risk of metal particles melting away from such supports and ending up free in the cathode ray tube so that the remaining parts present there could be polluted. In the former case the desired quality of the getter process would not be obtained. In the latter case a cathode ray tube could be damaged. Thus, for a qualitatively sound getter process it is necessary that the supports 9 and 10 in this cathode ray tube 4 be heated independently.

The embodiment of the heating apparatus represented in the FIGURE realizes this independent heating of the supports 9 and 10 by means of coil cores 6 and 8 arranged in the induction coils 5 and 7. The coil cores 6 and 8 permit mutually independent axial displacement. The coil cores 6 and 8 are axially displaced by means of respective displacing means 18 and 19 which are controlled by respective control units 16 and 17. These control units 16 and 17 control the coil core displacements in response to signals emanating from the respective detectors 14 and 15. The development of getter spots on the wall of the workpiece due to the evaporation of getter in the inductively heated supports 9 and 10 can be detected by these detectors 14 and 15 in various ways. The detectors 14 and 15 can, for example, detect the light emanating from the respective light sources 22 and 23. For example, once the getter in support 9 is evaporated and deposited on the wall, it will form a getter spot there which interrupts the light beam emitted by light source 22 due to which light detector 14 no longer receives this light beam and hence applies a signal to control-unit 16.

If the coil cores 6 and 8 are in the vicinity of the supports 9 and 10, the heating of the supports will take place. Once the heating of a single support has lasted sufficiently long, the associated coil core is axially moved away from the associated support, due to which this support encloses substantially no electromagnetic flux any longer so that the inductive heating of the associated support will be stopped.

The impedance of an induction coil remains substantially constant when the associated coil core is displaced but still remains within the turn(s) of the induction coil. In this case an axial displacement of a coil core in a single induction coil will have virtually no effect on the current through the remaining induction coil.

What is claimed is:

1. A heating apparatus comprising: a high-frequency generator, at least two heating inductors connected to the high-frequency generator for inductively heating workpieces in which each inductor includes an induction coil coupled to the high-frequency generator and a high-permeability coil core, means for displacing said coil cores within respective induction coils mutually independently, and at least one detector for detecting at least one process parameter in the induction heating process, said process parameter being determined exclusively by the workpiece, and wherein the displacing means independently displace the coil cores in response to detection signals received from the at least one detector in order to individually switch the transfer of energy on and off between said high-frequency generator and said workpieces.

2. A heating apparatus as claimed in claim 1, wherein each coil core has an axis and the displacing means displace each of the coil cores substantially axially.

3. A heating apparatus as claimed in claim 1 wherein said displacing means independently displace each of the coil cores in a direction away from its respective associated workpiece in order to effectively switch off the transfer of energy from an inductor to its respective associated workpiece.

4. A heating apparatus as claimed in claim 1 wherein the energy transfer between at least one inductor and its associated workpiece is effectively switched off by independently displacing its coil core away from its associated workpiece while high-frequency power is being supplied from the high-frequency generator to the induction coil of said one inductor.

5. A heating apparatus as claimed in claim 1 for inductively heating at least first and second workpieces, said apparatus comprising first and second heating inductors arranged in the vicinity of said first and second workpieces, respectively, first and second detectors for detecting a process parameter related to heating of said first and second workpieces, respectively, and wherein said displacing means comprise first and second devices individually coupled to a respective coil core of said first and second inductors for independently automatically moving the coil cores in a direction towards and away from the first and second workpieces in response to detection signals from said first and second detectors, respectively.

6. A heating apparatus as claimed in claim 5 wherein said first and second detectors comprise light detectors.

7. A heating apparatus as claimed in claim 1 wherein at least first and second workpieces are arranged along a common axis with respective axes of coil cores of first and second respective inductors, said coil cores being axially displaceable along said common axis by said displacing means.

* * * * *